US006547600B2

(12) United States Patent
Yen

(10) Patent No.: US 6,547,600 B2
(45) Date of Patent: Apr. 15, 2003

(54) ENGAGING STRUCTURE FOR ELECTRICAL WIRES OF A PLUG

(76) Inventor: Chun Chang Yen, No. 8, Lane 247, Nieu Pu Road, Hsinchu (TW)

( * ) Notice: Subject to any disclaimer, the term of this patent is extended or adjusted under 35 U.S.C. 154(b) by 0 days.

(21) Appl. No.: 09/904,520

(22) Filed: Jul. 16, 2001

(65) Prior Publication Data

US 2003/0013345 A1 Jan. 16, 2003

(51) Int. Cl.[7] ..... H01R 13/68
(52) U.S. Cl. ..... 439/622; 439/460
(58) Field of Search ..... 439/622, 368, 439/369, 448, 460, 461, 472

(56) References Cited

U.S. PATENT DOCUMENTS 2,136,498 A * 11/1938 Geyer ..... 439/601
3,986,765 A * 10/1976 Shaffer et al. ..... 439/314
4,713,023 A * 12/1987 Bixler et al. ..... 439/393
5,083,938 A * 1/1992 Poliak ..... 439/460
5,252,081 A * 10/1993 Hart ..... 439/98
6,315,600 B1 * 11/2001 Droesbeke ..... 439/460

* cited by examiner

*Primary Examiner*—Tho D. Ta
*Assistant Examiner*—James R. Harvey
(74) *Attorney, Agent, or Firm*—Rosenberg, Klein & Lee

(57) ABSTRACT

An engaging structure for electrical wires of a plug. The plug provides a pair of elastic inclined clips at an end of the connector. In assembly, the clips will firmly clamp the wires, or a cover surrounding the wires and when the wires or cover are pulled outward, the clips will clamp the wires or cover more firmly to prevent release or loosening from the plug

1 Claim, 4 Drawing Sheets

ENGAGING STRUCTURE FOR ELECTRICAL WIRES OF A PLUG

BACKGROUND OF INVENTION

As shown in FIG. 1, it is known that a conventional plug includes an inner connector (1) and an outer shell (2). An electrical wire (3) connected with a pin (31) and an electrical prong (4) is received in the inner connector (1) and all of the above means are put inside the shell (2). An insulated cover (32) provided around the wire (3) is clipped by the connector (1) and the shell (2). Since this frictional engagement between the wire (3) and the connector (1) as well as the shell (2) is not strong enough, the wire (3) or the cover (32) may be loosened when an accidental pulling occurs, and further the pin (31) may be moved with the result that the electrical connection will be inefficient.

Accordingly, the primary objective of this invention is to provide an engaging structure for electrical wires of a plug, which provides an elastic clip at the end of the connector to engage the wires or cover firmly for overcoming the drawback of a prior one and increasing the utilized effect. Now the features and advantages of the invention will be described in detail with reference to the accompanying drawings.

DETAILED DESCRIPTION OF THE PREFERRED EMBODIMENTS

Figure 2:
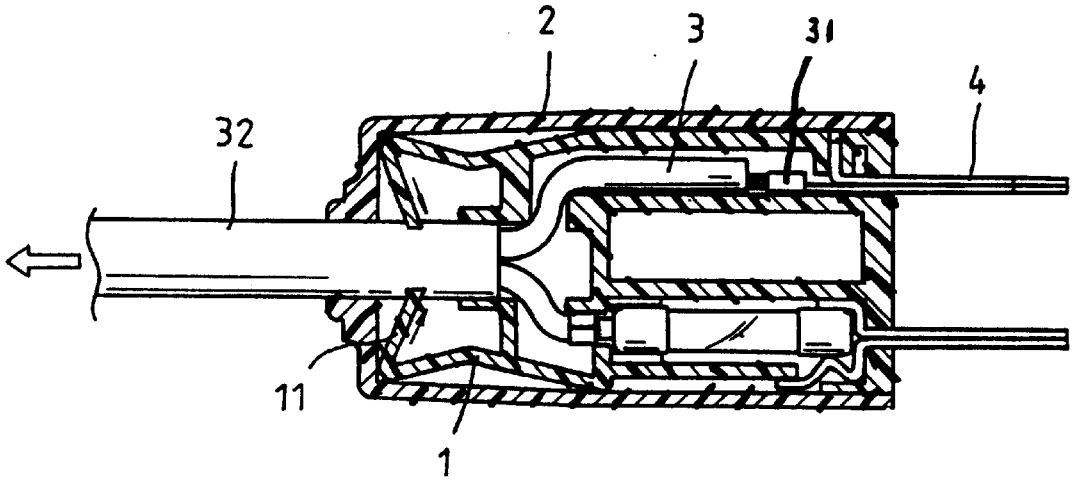
FIG. 2 is a cross-sectional plan view showing a plug according to the present invention.
Figure 1:
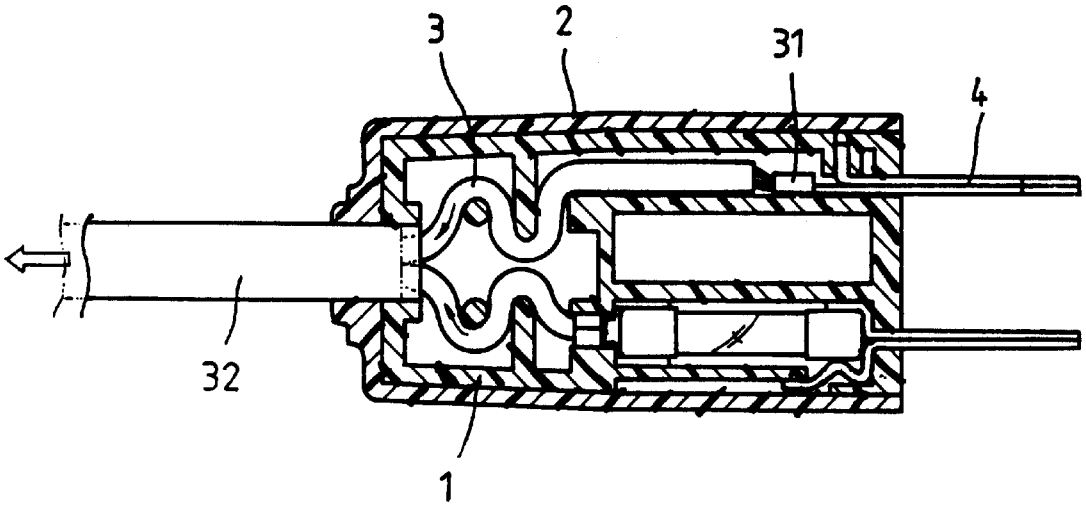
FIG. 1 (prior art)
FIG. 1 is a cross-sectional plan view showing a plug of a prior art structure.
Figure 3:
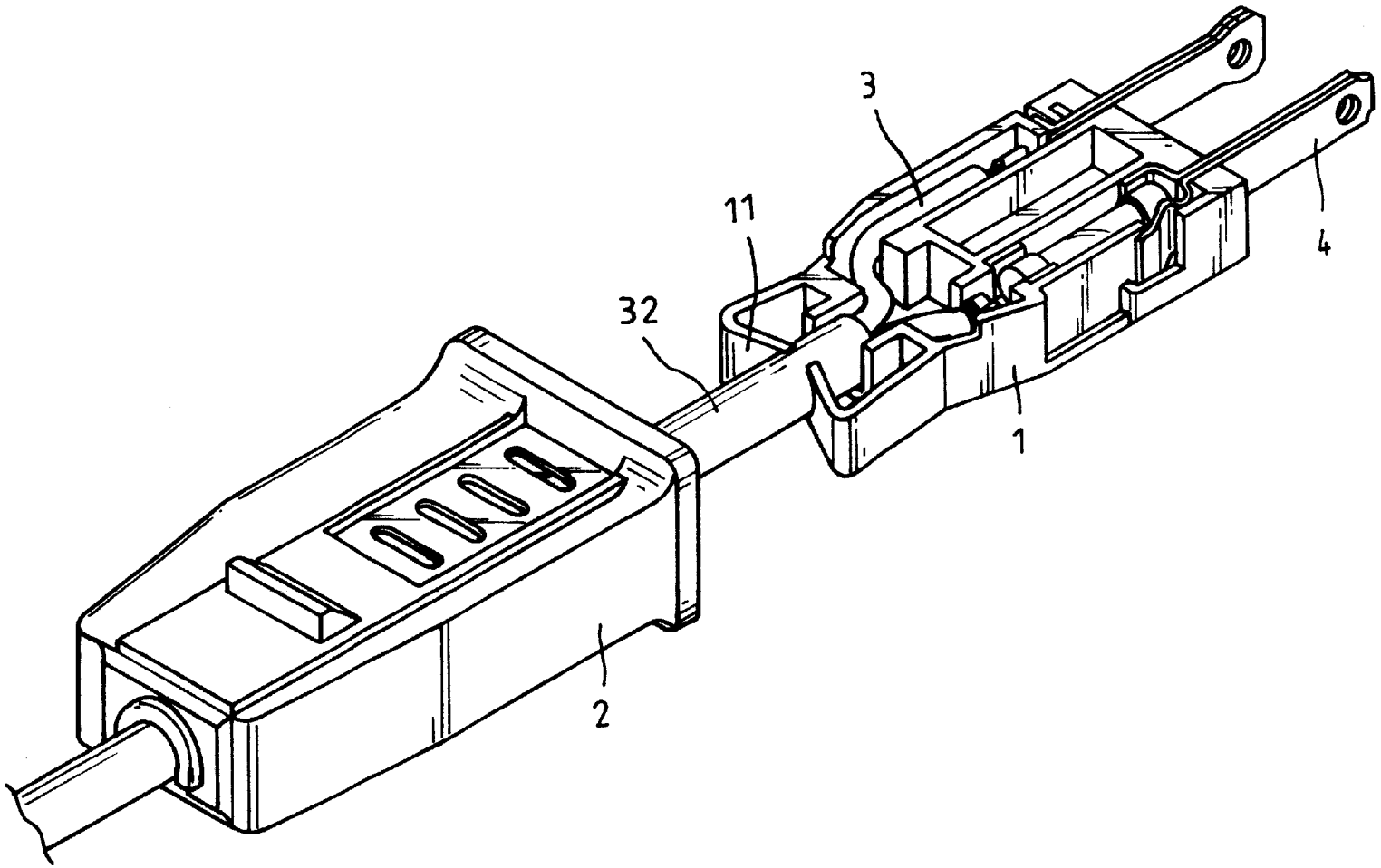
FIG. 3 is a perspective view showing a plug according to the present invention.
Figure 4:
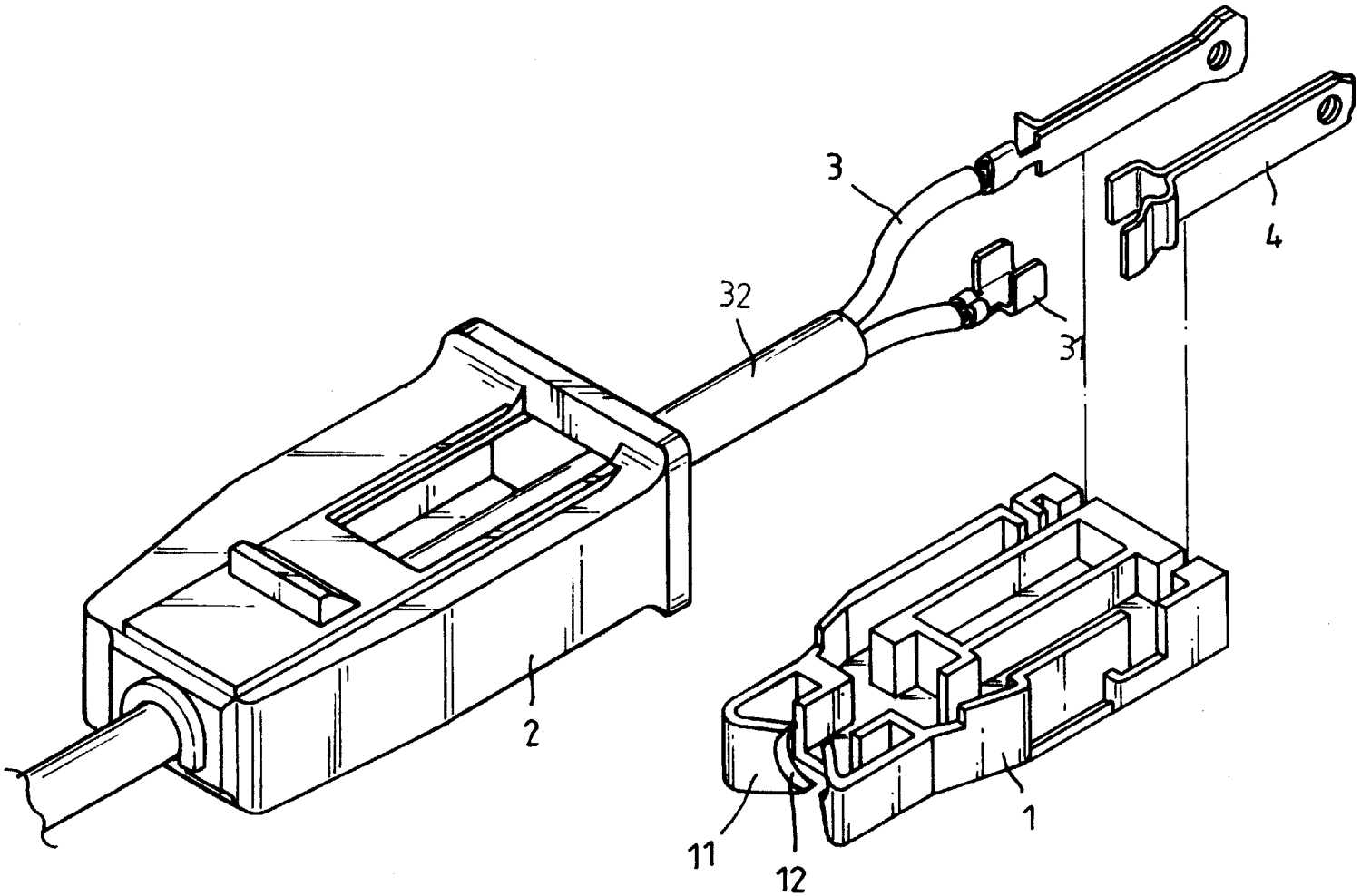
FIG. 4 is an exploded perspective view of FIG. 3 according to the present invention.

Please refer to FIGS. 2 through 4, where the present invention includes an inner connector (1) provided with electrical wires (3) and an electrical prong (4) connected with a contact (31), all of which are received in an outer shell (2) to complete a plug as similar to a conventional one. The prime characteristic of this invention is that it provides a pair of elastic clips (11) at each end of the inner connector (1). Each clip (11) is inwardly inclined toward the electrical prong (4) and is provided with an arched groove (12) at its end edge for firmly grasping the wires (3) or the insulated cover (32) in assembly.

Accordingly, if the wires (3) or the cover (32) is pulled outward, the clips (11) will be forced to clamp the wires (3) or the cover (32) more firmly. It is to be understood that the increased clamping force positively ensures the engagement between the wires and the plug which overcomes the previously identified drawback of a conventional plug.

Figure 5:
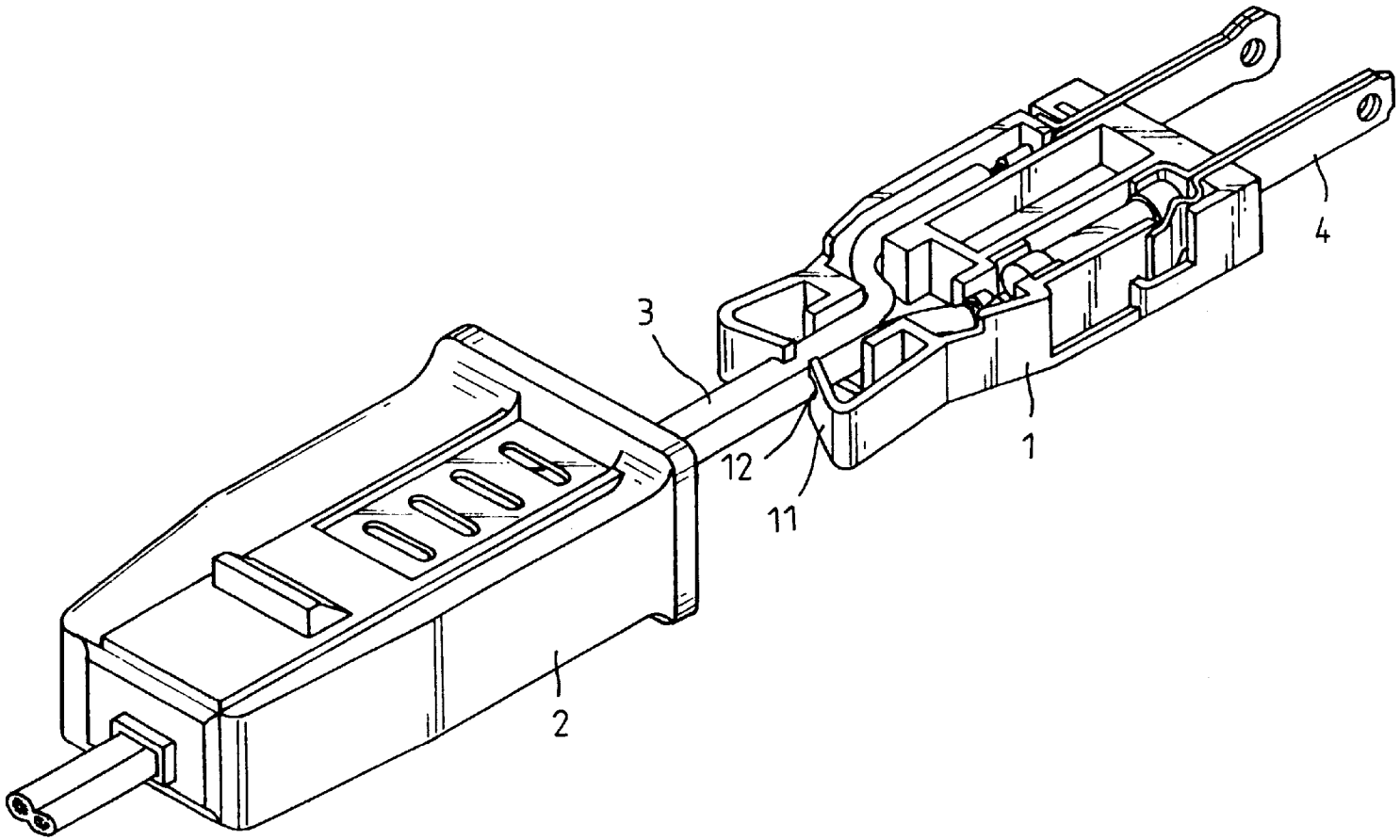
FIG. 5 is a perspective view showing another embodiment of a plug according to the present invention.

FIG. 5 shows another embodiment according to this invention. In this embodiment the shape and size of the arched groove (12) of the elastic clips (11) is changed to fit with an electrical wire (3), not contained within an insulated cover (32), for providing the same secure clamping effect.

What is claimed is:

1. An engaging structure for electrical wires extending from an electrical plug, said electrical plug having electrical prongs extending from a forward end of said electrical plug and said prongs being electrically coupled to said electrical wires, comprising:

(a) an outer shell;

(b) an inner connector slidably received within said outer shell from the forward end of said electrical plug, said inner connector having a pair of opposing elastic clip members forming one end section of said inner connector, each of said opposing elastic clip members having an arcuately contoured wall section a clip lug member inclined toward the forward end and terminating at an arched groove and engaging in grasping manner at least one of said electrical wires, said clip lug members of said elastic clip members being disposed to grasp said electrical wire therebetween with further retention responsive to said electrical wire being pulled rearward from said plug.

* * * * *